US005213252A

United States Patent [19]

Eylon

[11] Patent Number: 5,213,252

[45] Date of Patent: May 25, 1993

[54] METHOD TO PRODUCE SELECTIVELY REINFORCED TITANIUM ALLOY ARTICLES

[75] Inventor: Daniel Eylon, Dayton, Ohio

[73] Assignee: The United States of America as represented by the Secretary of the Air Force, Washington, D.C.

[21] Appl. No.: 883,518

[22] Filed: May 15, 1992

[51] Int. Cl.[5] ..... B23K 20/24; B23K 103/14; B23K 103/16

[52] U.S. Cl. ..... 228/176; 228/190; 228/265; 228/263.21; 148/670

[58] Field of Search ..... 228/190, 176, 265, 193, 228/263.21; 29/889.71; 148/669, 670

[56] References Cited

U.S. PATENT DOCUMENTS

| | | | |
|---|---|---|---|
| 3,942,231 | 3/1976 | Whitaker | 29/156.8 B |
| 4,301,584 | 11/1981 | Dillner et al. | 29/156.8 B |
| 4,343,593 | 8/1982 | Harris | 416/193 A |
| 4,482,398 | 11/1984 | Eylon et al. | 148/11.5 F |
| 4,612,066 | 9/1986 | Levin et al. | 148/20.3 |
| 4,733,816 | 3/1988 | Eylon et al. | 228/190 |
| 4,807,798 | 2/1989 | Eylon et al. | 228/190 |
| 4,809,903 | 3/1989 | Eylon et al. | 228/194 |
| 4,820,360 | 4/1989 | Eylon et al. | 148/133 |
| 4,822,432 | 4/1989 | Eylon et al. | 148/669 |
| 4,872,927 | 10/1989 | Eylon et al. | 148/669 |
| 4,907,736 | 3/1990 | Doble | 29/889.71 |
| 4,919,594 | 4/1990 | Wright et al. | 29/889.71 |

*Primary Examiner*—Kenneth J. Ramsey

*Attorney, Agent, or Firm*—Charles E. Bricker; Donald J. Singer

[57] ABSTRACT

A method for producing fiber reinforced titanium alloy articles which comprises casting a plurality of segments which can be joined to provide a unitary article, wherein at least one-half of the segments comprise at least one shallow cavity, treating the cast segments in such manner as to refine the microstructure of the segments, filling the cavity or cavities with reinforcing fibers and superplastic forming/diffusion bonding the segments into the desired article.

10 Claims, 1 Drawing Sheet

METHOD TO PRODUCE SELECTIVELY REINFORCED TITANIUM ALLOY ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the production of selectively reinforced titanium alloy articles, particularly alpha+-beta and near alpha titanium alloy articles.

The development of high performance airframes and gas turbine engines requires components which exhibit a high stiffness-to-weight ratio together with fracture and fatigue resistance. Such requirements can be met using titanium alloy metal matrix composites (Ti-MMC). The fabrication of Ti-MMC is currently done by the tedious process of layering titanium alloy foils with mats of reinforcement fibers, then superplastic forming/diffusion bonding (SPF/DB) the layered assembly into a unitary article, or by spraying molten alloy or alloy powder onto fiber mats, then diffusion bonding multiple layers of the metallized mat into a unitary article. The complexity of manufacturing and the associated high costs prevent Ti-MMC from being extensively used in current generations of airframe components.

Accordingly, it is an object of this invention to provide a novel method for producing selectively reinforced titanium alloy articles.

Other objects and advantages of the invention will be apparent to those skilled in the art.

SUMMARY OF THE INVENTION

In accordance with the present invention there is provided a method for producing fiber reinforced titanium alloy articles which comprises casting a pluality of segments which can be joined to provide a unitary article, wherein at least one-half of the segments comprises at least one shallow cavity, treating the cast segments in such manner as to refine the microstructure of the segments, filling the cavity or cavities with reinforcing fibers and superplastic forming/diffusion bonding the segments into the desired article.

DETAILED DESCRIPTION OF THE INVENTION

The alloy to be used in the practice of this invention can be an alpha+beta or near-alpha titanium alloy. Typical alloys include the following: Ti-6Al-4V, Ti-6Al-6V-2Sn, Ti-8Mn, Ti-7-Al-4Mo, Ti-4.5Al-5Mo-1.5Cr, Ti-6Al-2Sn-4Zr-6Mo, Ti-5Al-2Sn-2Zr-4Mo-4Cr, Ti-6Al-2Sn-4Zr-2Mo-2Cr, Ti-3Al-2.5V, Ti-5Al-2.5Sn, Ti-8Al-1Mo-1V, Ti-6Al-2Sn-4Zr-2Mo-0.1Si, Ti-6Al-2Nb-1Ta-0.8Mo, and Ti-2.25Al-11Sn-5Zr-1Mo. The alloy may further contain up to about 6 weight percent of a dispersoid such as boron, thorium or rare earth elements.

Figure 1:
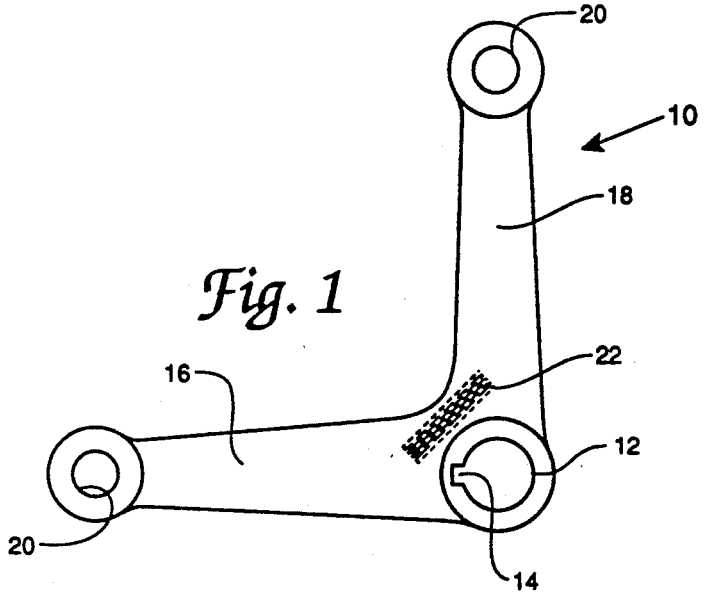
FIGS. 1 and 2 are plan and isometric views of a bellcrank, respectively.
Figure 2:
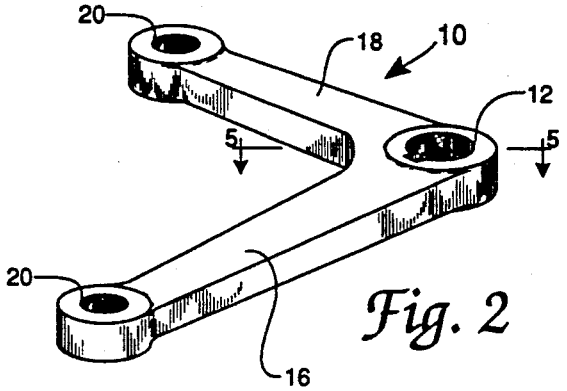

Referring to the drawings, FIG. 1 illustrates a bellcrank 10 having a bore 12 with keyway 14 for attachment to a shaft, not shown. Bellcrank 10 comprises arms 16 and 18, each having a bore 20, or other means, for attachment to an operating linkage, not shown. Bellcrank 10 is reinforced with a plurality of embedded fibers where the arms 16 and 18 intersect, indicated by the shaded area 22.

Figure 3:
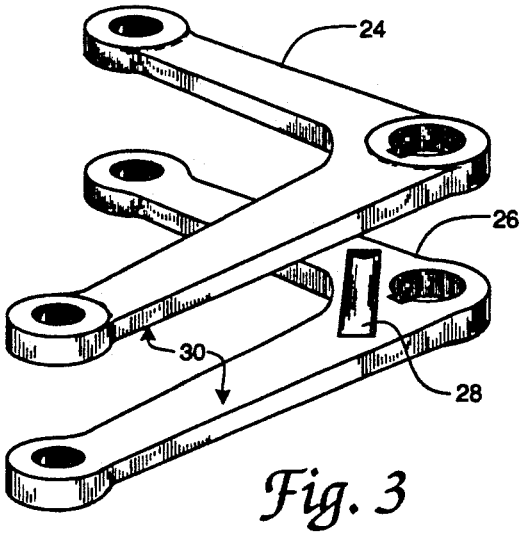
FIG. 3 is an isometric view illustrating cast halves of the bellcrank.
Figure 4:
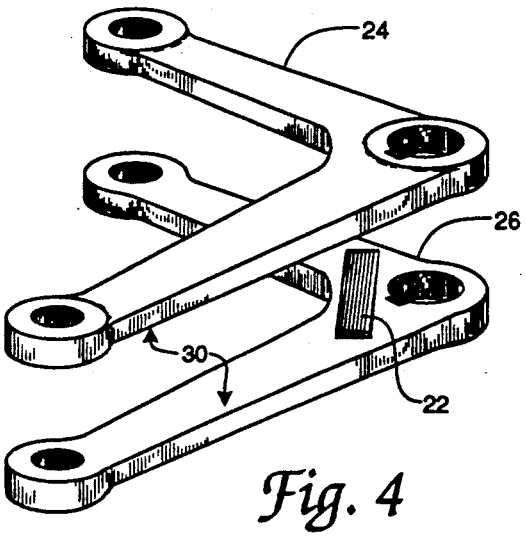
FIG. 4 illustrates the bellcrank halves of FIG. 3 with reinforcing fibers in the shallow cavity of one half.

Bellcrank 10 is fabricated from to segments 24 and 26, shown in FIGS. 3 and 4. Each of the segments comprises portions of the arms 16 and 18 and the bores 12 and 20, as described above. In the embodiment shown, the segments 24 and 26 are virtually mirror images, except that segment 26 also comprises a shallow cavity 28. Each of the segments has a mating surface 30.

Segments 24 and 26 can be cast using any casting technique known in the art. For complex shapes, such as turbine blades, investment casting is the presently preferred technique.

Investment casting is adaptable to automatic and production of relatively low cost, large-quantity runs. It is capable of producing true net shapes with accurate dimensions and very good surface finish that generally requires no further machining or surface finishing. In this method, a wax pattern is produced by injection molding. The pattern assembly is dipped in a ceramic slurry, stuccoed and dried. This is repeated several times to build a ceramic shell with sufficient strength to sustain the molding pressure. After drying, the wax pattern is removed by melting and the ceramic shell is dried and fired to achieve strength and stiffness. The ceramic shell is then filled with the molten titanium material, using a suitable apparatus. After casting, the ceramic shell is removed.

Following recovery of the castings from the mold, the castings may, optionally, be densified by Hot Isostatic Pressing (HIP). Titanium alloys dissolve their own oxides at high temperatures allowing a complete closure of all non-surface-connected porosity by diffusion bonding. The Hot Isostatic Pressing of titanium alloys may be carried out at about 50° above to 200° C. below the beta-transus temperature of the alloy at pressures of 10 to 45 Ksi for 2 to 4 hours. The term "beta-transus" refers to the temperature at the line on the phase diagram for the alloy separating the $\beta$-phase field from the $\alpha+\beta$ region where the $\alpha$ and $\beta$ phases coexist. Hot Isostatic Pressing can enhance critical mechanical properties such as fatigue resistance, while causing no serious degradation in properties such as fracture toughness, fatigue crack growth rate or tensile strength.

The typically coarse microstructure of the cast segments is then refined by one of three methods: BUS, as set forth in U.S. Pat. No. 4,482,398; TCP, as set forth in U.S. Pat. No. 4,612,066; or HTH, as set forth in U.S. Pat. No. 4,820,360, all of which are incorporated herein by reference.

Briefly, the BUS method comprises beta-solution treatment of a casting with rapid cooling to room temperature, preferably by quenching, following by a relatively high temperature, relatively long aging heat treatment. The beta-solution treatment is accomplished by heating the casting to approximately the beta-transus temperature of the alloy, i.e., about 3% below to about 10% above the beta-transus temperature (in °C.), followed by rapid cooling. The casting is then aged by heating to about 10 and 20 percent below the beta-transus (in °C.) for about 4 to 36 hours, followed by air cooling to room temperature.

The TCP method comprises beta-solution treatment of a casting with rapid cooling to room temperature, preferably by quenching, followed by hydrogenation/-dehydrogenation of the article. Titanium and its alloys have an affinity for hydrogen, being able to dissolve up to about 3 weight percent (60 atomic percent) hydrogen at 590° C. While it may be possible to hydrogenate the article to the maximum quantity, it is presently preferred to hydrogenate the article to a level of about 0.1 to 2.3 weight percent of hydrogen.

Hydrogenation is conducted in a suitable, closed apparatus at an elevated temperature by admitting sufficient hydrogen to attain the desired concentration of hydrogen in the alloy. The hydrogenation step is conducted at a temperature of about 50% to 96% of the beta-transus temperature of the alloy. Heating of the article to the desired temperature is conducted under an inert atmosphere. When the hydrogenation temperature is reached, hydrogen is added to the atmosphere within the apparatus. The partial pressure of hydrogen added to the atmosphere and the time required for hydrogenation are dependent upon such factors as the size and cross-section of the article, the temperature of hydrogenation and the desired concentration of hydrogen in the article.

After hydrogenation, the admission of hydrogen to the apparatus is discontinued, and the apparatus is flushed with a non-flammable mixture of inert gas and about 4% hydrogen. The article is allowed to equilibrate at the hydrogenation temperature for about 10 to 20 minutes, and then furnace cooled.

Dehydrogenation is accomplished by heating the article, under vacuum, to a temperature of about 50% to 96% of the beta-transus temperature of the alloy. The time for hydrogen removal will depend on the size and cross-section of the article and the volume of hydrogen to be removed. The time for dehydrogenation must be sufficient to reduce the hydrogen content in the article to less than the maximum allowable level. For the alloy Ti-6Al-4V, the final hydrogen level must be below 120 ppm (0.012 weight percent) to avoid degradation of physical properties such as room temperature ductility.

The HTH method comprises hydrogenation of the article, cooling the hydrogenated article at a controlled rate to room temperature, dehydrogenating the article and cooling the dehydrogenated article at a controlled rate to room temperature. Conditions for hydrogenation/dehydrogenation are similar to the conditions set forth previously. The rate of cooling is about 5° to 40° C. per minute.

Following refinement of the microstructure, reinforcing fibers are placed in the cavity 28 and the segments are bonded together. Several high strength/high stiffness filaments or fibers for reinforcing titanium alloys are commercially available, including silicon carbide, silicon carbide-coated boron, boron carbide-coated boron and silicon-coated silicon carbide. For ease of handling, it may be desirable to introduce the filaments or fibers into the article in the form of a sheet or mat. Such a sheet may be fabricated by laying out a plurality of filaments in parallel relation upon a suitable surface and wetting the filaments with a fugitive thermoplastic binder, such as polystyrene. After the binder has solidified, the filamentary material can be handled as one would handle any sheet-like material. Alternatively, a plurality of chopped fibers or filaments may be felted and the felted fibers bound together with a fugitive binder.

Figure 5:
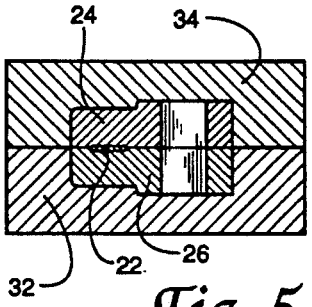
FIG. 5 illustrates bonding of the bellcrank halves.

Under superplastic conditions, the titanium matrix with the refined microstructure can be made to flow without fracture occurring, thus providing intimate contact between the matrix material and the fiber. The contacting surfaces of matrix material bond together by a phenomenon known as diffusion bonding. The bonding operation is illustrated in cross-section in FIG. 5. The segments 26 and 28 are placed within rigid dies 32 and 34, which are then closed with the application of temperature, time and pressure sufficient to bond the mating surfaces 30. If a fugitive binder is used with the reinforcing material, such binder must be removed prior to consolidation of the segments, without pyrolysis occurring. By using an apparatus equipped with heatable dies and a vacuum chamber surrounding at least the dies, removal of the binder and consolidation may be accomplished without having to relocate the segments from one piece of equipment to another. Typical SPF/DB conditions include a temperature about 10° to 100° C. below the beta-transus temperature of the alloy, a pressure of about 10 to 100 MPa (1.5 to 15 Ksi) and time about 15 minutes to 24 hours.

Although the invention has been described and illustrated in terms of a bellcrank, it will be apparent to those skilled in the art that the method of this invention is applicable to the fabrication of any selectively reinforced titanium alloy article. The advantages of this invention include precision casting of the article segments, minimal handling of the segments and opportunity for inspection of the segments prior to bonding.

Various modifications may be made to the invention as described without departing from the spirit of the invention or the scope of the appended claims.

I claim:

1. A method for producing fiber reinforced titanium alloy articles which comprises casting a plurality of segments which can be joined to provide a unitary article, wherein at least one-half of the segments comprise at least one shallow cavity, heat treating the cast segments in such manner as to refine the microstructure of the segments, filling the cavities with reinforcing fibers and superplastic forming/diffusion bonding the segments into the desired reinforced article.

2. The method of claim 1 wherein said segments are cast from an alpha+beta or near-alpha titanium alloy.

3. The method of claim 1 further comprising hot isostatic pressing said cast segments.

4. The method of claim 1 wherein said cast segments are heat treated by heating said cast segments to approximately the beta-transus temperature of the alloy, rapidly cooling the heated segments to room temperature, heating the rapidly cooled segments to about 10 to 20% below said beta-transus temperature, in degrees Centigrade, for about 4 to 36 hours, and air cooling the segments to room temperature.

5. The method of claim 1 wherein said cast segments are heat treated by heating said cast segments to approximately the beta-transus temperature of the alloy, rapidly cooling the heated segments to room temperature, hydrogenating the segments at a temperature about 50 to 96% of said beta-transus temperature, and dehydrogenating the segments at a temperature about 50 to 96% of said beta-transus temperature.

6. The method of claim 5 wherein said segments are hydrogenated to about 0.1 to 2.3 weight percent hydrogen.

7. The method of claim 1 wherein said cast segments are heat treated by hydrogenating the segments at a temperature about 50 to 96% of said beta-transus temperature, cooling the hydrogenated segments, dehydrogenating the segments at a temperature about 50 to 96% of said beta-transus temperature and cooling the dehydrogenated segments.

8. The method of claim 7 wherein said segments are hydrogenated to about 0.1 to 2.3 weight percent hydrogen.

9. The method of claim 7 wherein said segments are cooled at a controlled rate of about 5° to 40° C. per minute.

10. The method of claim 1 wherein said reinforcing fiber is selected from the group consisting of silicon carbide, silicon carbide-coated boron, boron carbide-coated boron and silicon-coated silicon carbide.

* * * * *